US009004748B2

(12) United States Patent
Helfer et al.

(10) Patent No.: US 9,004,748 B2
(45) **Date of Patent: *Apr. 14, 2015**

(54) BALANCE SPRING WITH TWO HAIRSPRINGS AND IMPROVED ISOCHRONISM

(71) Applicant: Montres Breguet S.A., L'Abbaye (CH)

(72) Inventors: Jean-Luc Helfer, Le Landeron (CH); Kaspar Trumpy, Soleure (CH)

(73) Assignee: Montres Breguet S.A., L'Abbaye (CH)

( * ) Notice: Subject to any disclaimer, the term of this patent is extended or adjusted under 35 U.S.C. 154(b) by 83 days.

This patent is subject to a terminal disclaimer.

(21) Appl. No.: 13/731,486

(22) Filed: Dec. 31, 2012

(65) Prior Publication Data

US 2013/0176834 A1 Jul. 11, 2013

(30) Foreign Application Priority Data

Jan. 5, 2012 (EP) ..... 12150230

(51) Int. Cl.
*G04B 17/06* (2006.01)

(52) U.S. Cl.
CPC ..... *G04B 17/063* (2013.01); *G04B 17/066* (2013.01)

(58) Field of Classification Search
USPC ..... 368/171, 175, 177, 178
See application file for complete search history.

(56) References Cited

U.S. PATENT DOCUMENTS

| | | | | |
|---|---|---|---|---|
| 30,247 | A * | 10/1860 | Reed | 368/175 |
| 109,826 | A * | 12/1870 | Kline | 368/175 |
| 469,914 | A * | 3/1892 | Olsen | 368/175 |
| 570,394 | A * | 10/1896 | Griscom | 368/175 |
| 8,480,294 | B2 * | 7/2013 | Helfer et al. | 368/175 |
| 2009/0236782 | A1 | 9/2009 | Buhler et al. | |
| 2009/0245030 | A1 | 10/2009 | Buhler et al. | |
| 2010/0027382 | A1 * | 2/2010 | Daout et al. | 368/175 |
| 2010/0110840 | A1 * | 5/2010 | Zaugg et al. | 368/177 |
| 2010/0149927 | A1 * | 6/2010 | Zaugg et al. | 368/177 |
| 2011/0096636 | A1 * | 4/2011 | Pellet | 368/127 |
| 2011/0199866 | A1 * | 8/2011 | Zaugg et al. | 368/177 |
| 2011/0249537 | A1 * | 10/2011 | Daout et al. | 368/177 |
| 2011/0310711 | A1 * | 12/2011 | Bifrare et al. | 368/177 |
| 2012/0008467 | A1 | 1/2012 | Helfer et al. | |

FOREIGN PATENT DOCUMENTS

| | | | |
|---|---|---|---|
| EP | 2 104 006 | A1 | 9/2009 |
| EP | 2 105 807 | A1 | 9/2009 |
| EP | 2 405 312 | A1 | 1/2012 |

OTHER PUBLICATIONS

European Search Report issued Sep. 3, 2012 in corresponding European Application No. 12 15 0230 filed Jan. 5, 2012 (with an English Translation).

* cited by examiner

*Primary Examiner* — Amy Cohen Johnson
*Assistant Examiner* — Matthew Powell
(74) *Attorney, Agent, or Firm* — Oblon, McClelland, Maier & Neustadt, L.L.P.

(57) ABSTRACT

A balance spring includes a first hairspring, a second hairspring, and an attachment member securing an outer coil of the first hairspring to one end of the second hairspring so as to form a dual balance spring in series. A curve of the first hairspring and a curve of the second hairspring each have a continuously variable pitch and are symmetrical relative to a straight line parallel to first and second planes and pass through a median plane of projection of the attachment member. Each hairspring further includes at least two counterweights so as to compensate for an unbalance formed by a mass of the attachment member and personalize an anisochronism slope of the balance spring.

19 Claims, 6 Drawing Sheets

BALANCE SPRING WITH TWO HAIRSPRINGS AND IMPROVED ISOCHRONISM

This application claims priority from European Patent Application No. 12150230.6 filed Jan. 5, 2012, the entire disclosure of which is incorporated herein by reference.

FIELD OF THE INVENTION

The invention relates to a balance spring used to form a sprung balance resonator whose curvature allows development with a substantially fixed centre of mass.

BACKGROUND OF THE INVENTION

European Patent Nos. EP 2 184 652, EP 2 196 867 and EP 2 105 807 explain how to fabricate balance springs with curve elevation made of micro-machinable materials respectively using three parts, two parts or a single part. These documents are incorporated herein by reference.

It is known to apply the Phillips criteria to determine the theoretical curvature of a terminal curve. However, the Phillips criteria are actually an approximation which is not necessarily satisfactory if an even lower variation in rate is required.

SUMMARY OF THE INVENTION

It is an object of the present invention to overcome all of part of aforecited drawbacks by proposing a balance spring that respects predetermined conditions able to reduce the displacement of the centre of mass of the balance spring in contraction and expansion.

The invention therefore relates to a balance spring including a first hairspring, the curve of which extends in a first plane and whose inner coil has a collet, a second hairspring, the curve of which extends in a second plane parallel to the first plane, an attachment member securing the outer coil of the first hairspring to the outer coil of the second hairspring so as to form a dual balance spring in series, characterized in that the curve of the first hairspring and the curve of the second hairspring each have a continuously variable pitch and are symmetrical relative to a straight line parallel to the first and second planes and passing through the median plane of projection of the attachment member, wherein each curve has a tendency for the following relation to be substantially zero:

$$\vec{P}^{(n)} = \frac{n+1}{L^{n+1}} \int_0^L ds \cdot s^n \cdot \vec{x}(s)$$

where:

$\vec{P}^{(n)}$ is the moment of the balance spring of order n;

L is the length of the balance spring;

$s^n$ represents the curvilinear abscissa along the balance spring to the power of n;

$\vec{x}(s)$ is the parameterization of the balance spring by the curvilinear abscissa thereof.

so as to reduce the displacement of its centre of mass during contraction and expansion and in that each hairspring includes at least two counterweights to compensate for the unbalance formed by the mass of the attachment member and to personalise the anisochronism slope of the balance spring.

In accordance with other advantageous features of the invention:

- Said at least two counterweights are symmetrical along said same straight line as the curves;
- Two counterweights are located beside the attachment member and two other counterweights are located on the side opposite the attachment member so as to minimise the unbalance;
- Each counterweight is substantially H-shaped, the parallel arms of the H being substantially parallel to the local curvature of the hairspring with which it is associated;
- The stiffness and/or mass added locally by said counterweights and said attachment member are used to modify the anisochronism slope of the balance spring;
- The main faces of the attachment member are substantially parallel to said line of symmetry;
- The inner coil of the second hairspring comprises a shifting device arranged to be attached to a balance spring stud in the plane of the second hairspring;
- The shifting device includes a piece extending from the inner coil of the second hairspring, said piece being more rigid than said second hairspring to avoid providing elastic torque;
- The extension piece is connected to the inner coil via a substantially U-shaped bend;
- The extension piece is integral with the second hairspring;
- The extension piece is made more rigid by a thickness that is at least three times greater than that of said second hairspring;
- The piece may be partially pierced to decrease the mass thereof;
- The inner coil of the first hairspring includes a device for enlarging the collet in the plane of the first hairspring;
- The enlarging device includes a flange extending the inner coil of the first hairspring, said flange being more rigid than said first hairspring to avoid providing elastic torque;
- The flange is substantially U-shaped;
- The flange is integral with the first hairspring;
- The balance spring is formed from silicon;
- The balance spring includes at least one part coated with silicon dioxide so as to limit the sensitivity thereof to temperature variations and mechanical shocks.

Consequently, advantageously according to the invention, it is possible to manufacture a balance spring respecting predetermined conditions so as to reduce the displacement of the centre of mass of the balance spring in contraction and expansion. This small or slight displacement advantageously reduces the bottom of the anisochronism curves to a value substantially equal to or less than 0.5 $s \cdot j^{-1}$. Moreover, advantageously according to the invention, the anisochronism slope of the balance spring may be personalised in order to compensate for the slope given by the delay of the escapement.

Moreover, the invention relates to a resonator for a timepiece, including a balance characterized in that the balance cooperates with a balance spring according to any of the preceding variants.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

The rate variations of a mechanical watch relative to the theoretical frequency thereof are mainly due to the escapement and to the sprung balance resonator. Two types of rate variations can be differentiated, depending upon whether they are caused by the oscillation amplitude of the balance or by the position of the timepiece movement. This is why, for anisochronism tests, a timepiece movement is tested in six positions: 2 horizontal (dial facing up and down) and 4 vertical positions (crown stem rotated through 90° from an upward facing position). From the six distinct curves thereby obtained, the maximum variation between said curves, also called the "antinode" is determined, expressing the maximum rate variation of the movement in seconds per day ($s \cdot j^{-1}$).

The escapement induces a rate variation according to the amplitude of the balance which is difficult to adjust. Consequently, the balance spring is generally adapted so that the variation thereof according to the same amplitude is substantially opposite to that of the escapement. Moreover, the balance spring is adapted so that the variation thereof is minimal between the four vertical positions.

Attempts have been made to set out the necessary balance spring adaptations in mathematical terms in order to determine ideal curves by calculations. Geometrical conditions were set out notably by Messrs Phillips and Grossmann for designing a satisfactory balance spring, i.e. wherein the centre of mass of the balance spring remains on the balance axis. However, current conditions are rough approximations. Consequently, since very small displacements of the centre of mass can cause large rate variations, the rate variations obtained by following current geometrical conditions are often disappointing.

This is why, advantageously according to the invention, new conditions are set out below for obtaining better rate variation results than with current geometrical conditions, particularly those decreed by Messrs Phillips and Grossmann.

<<An nth order balance spring moment>>, $\vec{P}^{(n)}$ is defined by the following formula:

$$\vec{P}^{(n)} = \frac{n+1}{L^{n+1}} \int_0^L ds \cdot s^n \cdot \vec{x}(s) \tag{1}$$

where:

L is the length of the balance spring;

$s^n$ represents the curvilinear abscissa along the balance spring to the power of n;

$\vec{x}(s)$ is the parameterization of the balance spring by the curvilinear abscissa thereof.

Thus, in order to obtain a fixed centre of mass, for each nth order, the balance spring moment $\vec{P}^{(n)}$ must be zero. It is not possible to calculate all the orders since there is an infinite number of them. Thus, the larger the number of orders where the zero relation (1) is respected, the more the quantity of displacement of the centre of mass will be decreased.

Figure 1:
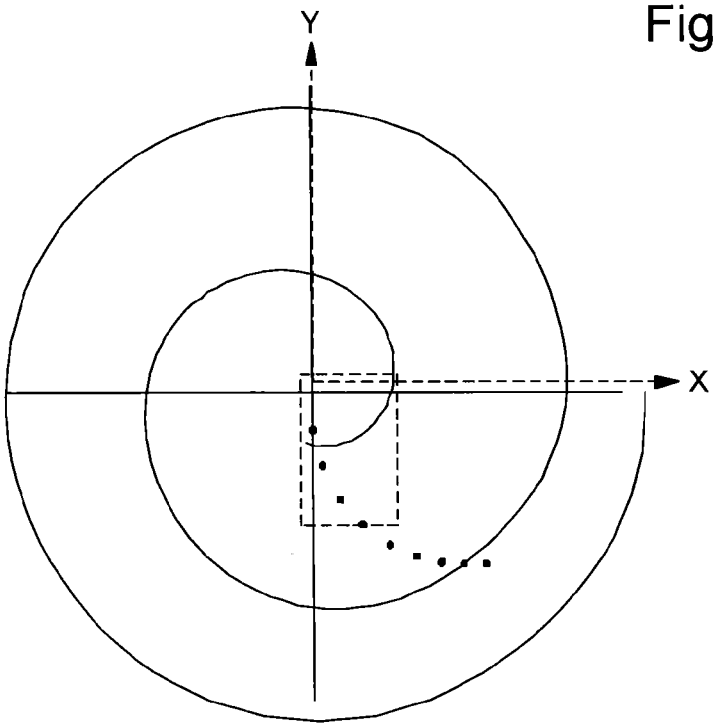
FIGS. 1 to 2 are diagrams explaining the coherent reasoning.

In the example illustrated in FIG. 1, eight order moments of the balance spring are represented by points which define an "ideal" theoretical curve, via parametrization using a polynomial including at least as many coefficients as orders (in our case at least eight).

Figure 9:
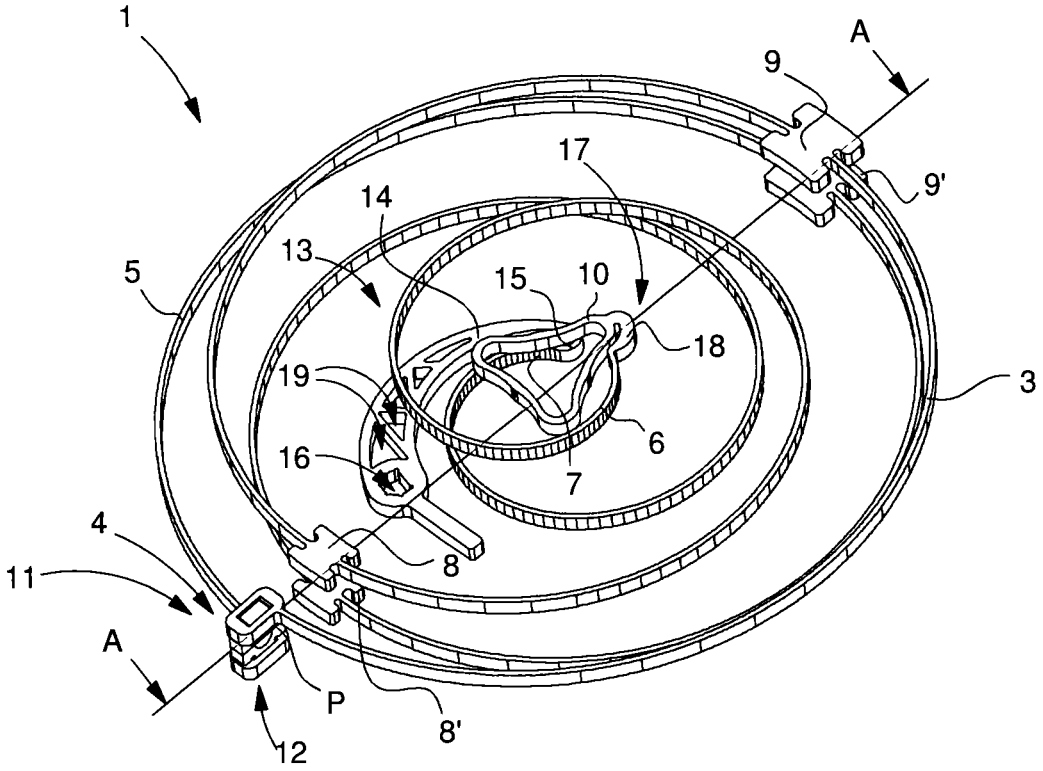
FIGS. 9 and 10 are perspective diagrams of a balance spring according to the invention.
Figure 10:
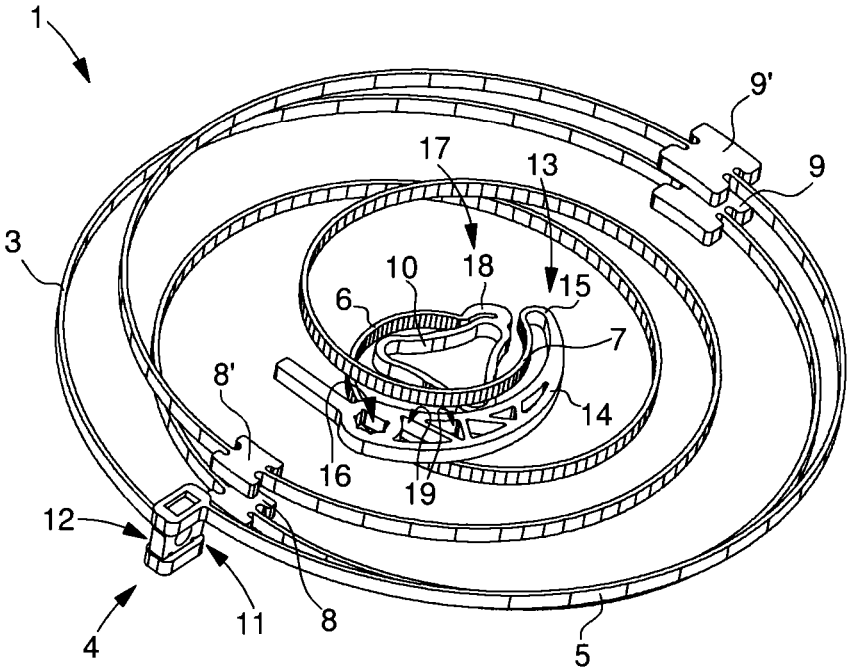
Figure 11:
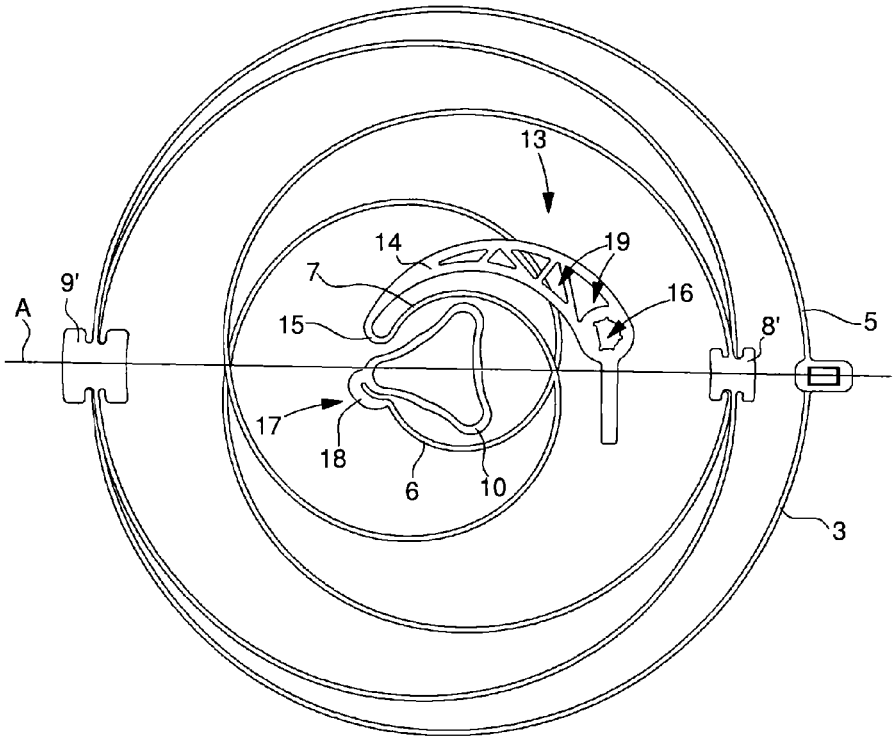
FIG. 11 is a top view of the balance spring of FIGS. 9 and 10.

In order to apply these zero moment conditions of the balance spring, we start with a balance spring of the type shown in FIGS. 9 to 11, i.e. a balance spring 1 including a first hairspring 3, the curve of which extends in a first plane, and a second hairspring 5, the curve of which extends in a second plane parallel to the first plane. Each end of hairspring 3, 5 is preferably secured by an attachment member 4 so as to form a dual balance spring in series.

As explained above, it is possible to fabricate this type of balance spring using the methods explained in European Patent Nos EP 2 184 652, EP 2 196 867 et EP 2 105 807 from micro-machinable materials such as silicon, respectively using three parts, two parts or a single part. Of course, this type of balance spring may be fabricated from other methods and/or other materials.

In order to simplify the calculations, the curve of the first hairspring 3 and the curve of the second hairspring 5 preferably each include a continuously variable pitch and are symmetrical relative to a straight line A parallel to the first and second planes passing through the centre of the median plane P of projection of attachment member 4 and the centre of the balance staff.

Consequently, by way of example, for each hairspring 3, 5, the first seven orders must respect the following relations:

$$P_x^{(0)}=0 \tag{2}$$

$$P_y^{(1)}=2P_y^{(0)} \tag{3}$$

$$P_x^{(2)}=3P_x^{(1)} \tag{4}$$

$$P_y^{(3)}=4P_y^{(2)}-8P_y^{(0)} \tag{5}$$

$$P_x^{(4)}=5P_x^{(3)}-20P_x^{(1)} \tag{6}$$

$$P_y^{(5)}=6P_y^{(4)}-40P_y^{(2)}+96P_y^{(0)} \tag{7}$$

$$P_x^{(6)}=7P_x^{(5)}-70P_x^{(3)}+336P_x^{(1)} \tag{8}$$

Figure 2:
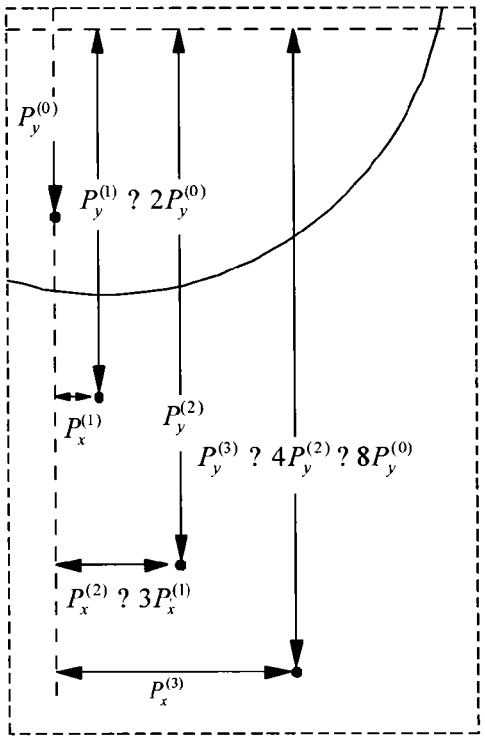
Figure 3:
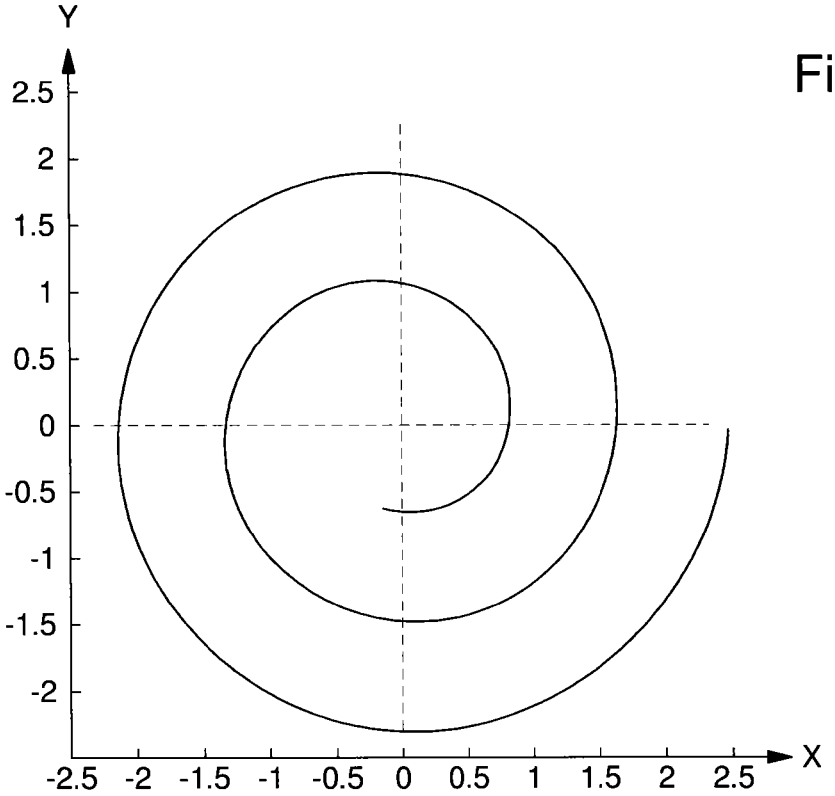
FIGS. 3 to 5 are calculation examples of curves with 2.3 coils respectively respecting the moment equations up to second, third and fourth orders.

As explained above, the higher the number of relations (2)-(8) respected, the more the displacement of the centre of mass of the balance spring 1 will be limited. By way of comparison, the Phillips conditions are close to the relation (2), i.e. a first order approximation. An application of the relations (2)-(5) is shown in FIG. 2 which is a partial enlarged view of FIG. 1.

Using parametrization, as explained above, it is possible to define a large variety of hairspring curves depending upon the inertia selected for the balance, the material, the section and length of the balance spring, but also the coefficients of the parametrization polynomials. It is also possible to choose particular solutions for example limiting the number of orders and/or number of coils.

Figure 4:
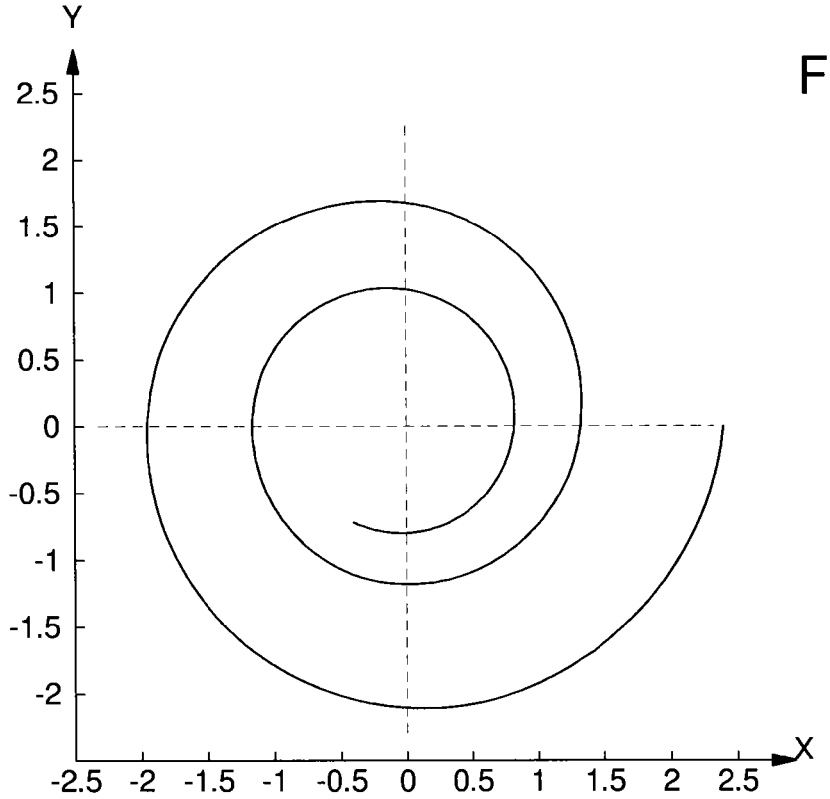
Figure 5:
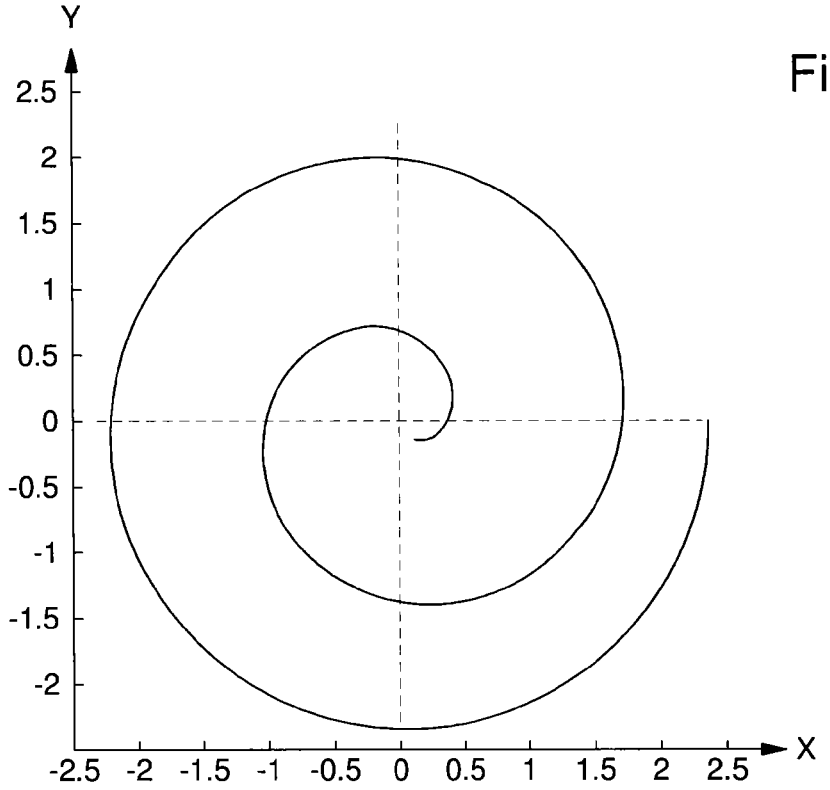
Figure 6:
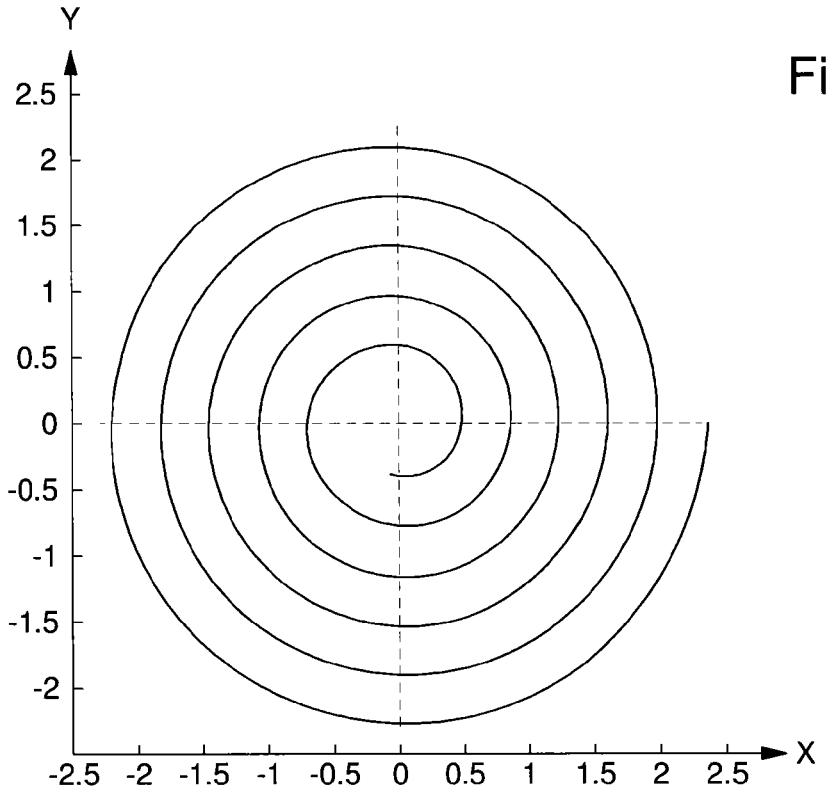
FIGS. 6 to 8 are calculation examples of curves with 5.3 coils respectively respecting the moment equations up to second, third and fourth orders.
Figure 7:
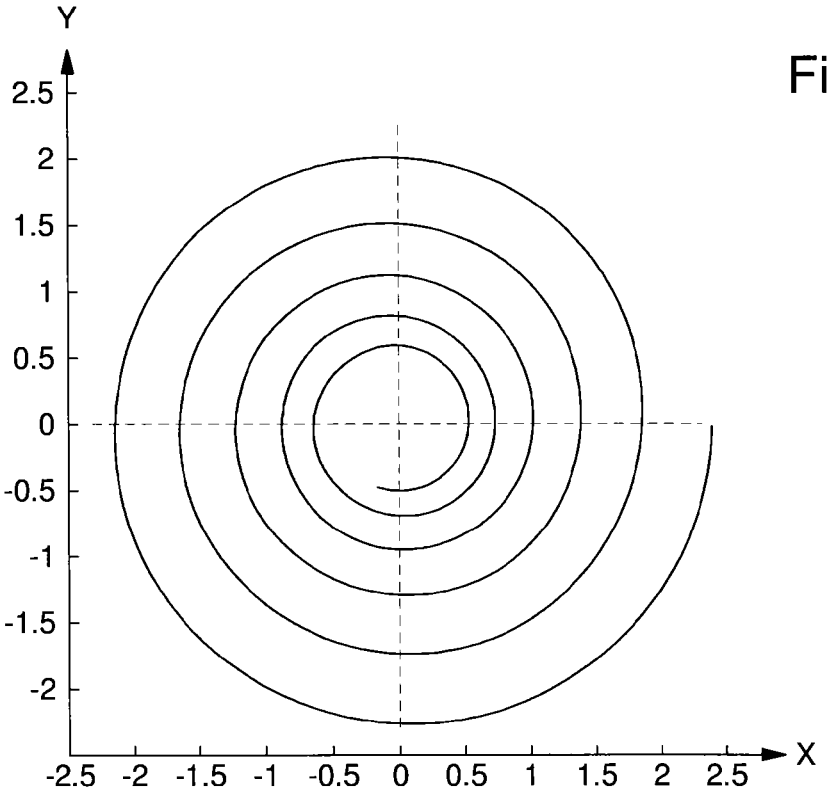
Figure 8:
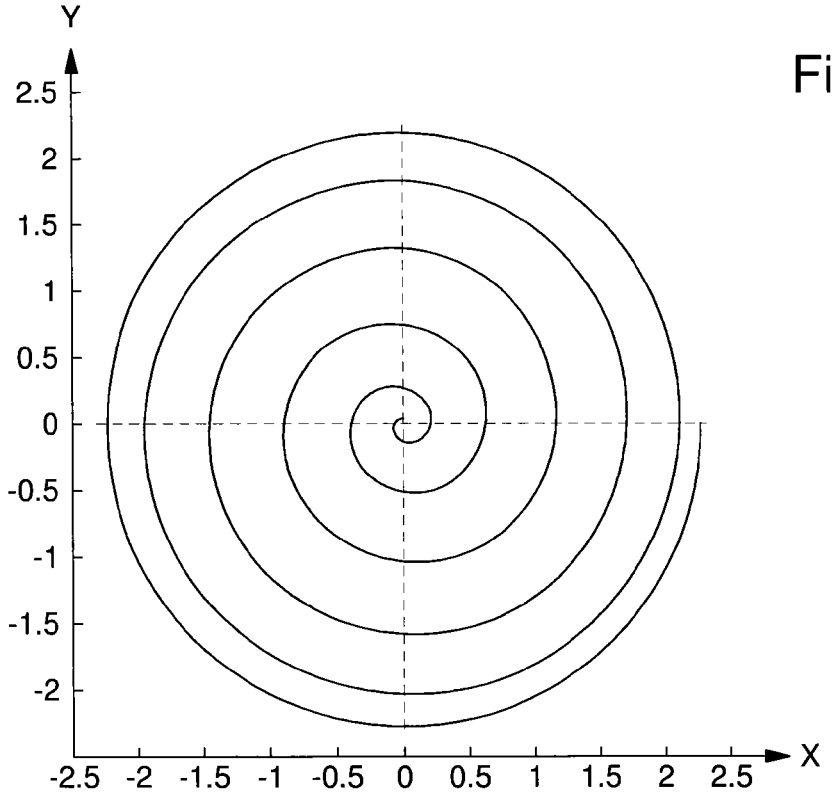

Possible curve simulations are shown in FIGS. 3 to 8. Thus, in order to form FIG. 3, the parametrization is limited to the relations (2) to (4) with a balance spring having 2.3 coils and a 2nd degree parametrization polynomial. FIG. 4 shows parametrization with a 3rd degree polynomial from the relations (2) to (5), again limiting the winding to 2.3 coils. Finally, FIG. 5 shows parametrization with a 4th degree polynomial from the relations (2) to (6), limiting the winding to 2.3 coils. FIGS. 6 to 8 show the same criteria respectively as FIGS. 3 to 5, but increasing the winding from 2.3 coils to 5.3 coils. It is seen that there is an infinite number of curve solutions respecting the relations (2)-(8) set out above.

As illustrated in FIGS. 9 to 11, the end 6 of hairspring 3 is connected to a collet 10 in a single piece, and the end 7 of hairspring 5, which is opposite attachment member 4, is arranged to cooperate with a balance spring stud (not shown). Moreover, as seen in FIGS. 9 to 11, the main faces 11, 12 of attachment member 4 are substantially parallel to the line of symmetry A.

In the particular case of FIGS. 9 to 11, in which balance spring 1 is formed of three parts as explained in European Patent No. 2 184 652, in addition to respecting the highest number of relations (2)-(8), it also becomes necessary to compensate for the unbalance caused by attachment member 4, i.e. to compensate for the mass of attachment member 4 relative to the distance thereof from the balance axis.

Thus, as illustrated in FIGS. 9 to 11, each hairspring 3, 5 preferably includes at least two counterweights 8-9, 8'-9' which are symmetrical along the same line A as the curves so as to compensate for the unbalance formed by the mass of attachment member 4 and to personalise the anisochronism slope of balance spring 1. Preferably, the masses of counterweights 8, 8' and 9, 9' are substantially equal and the sum thereof is larger or smaller than that of attachment member 4, depending upon the difference in distance, on the one hand between attachment member 4 and the balance axis, and on the other hand, between counterweights 8, 8', 9, 9' and said balance axis.

Indeed, it has been empirically demonstrated that two single counterweights on the opposite side of the attachment member did not lower the bottom of the variation in rate below 1.4 $s \cdot j^{-1}$. This arises from the fact that although the counterweights perfectly balance the unbalance for an angle of rotation of the collet of 0°, this is no longer the case when the collet rotates at a certain angle since the radial distance of attachment member 4 does not vary in the same way as the radial distance of counterweights 9, 9'.

This is why, in order to better balance the unbalance over a usual angle of rotation range from 0° to around 300°, at least two additional counterweights 8, 8' are added by placing them at other places on hairsprings 3, 5. Thus, it was found that four counterweights 8, 8', 9, 9' all aligned on axis A as seen in FIG. 11, with two 8, 8' beside attachment member 4 and two 9, 9' on the opposite side to attachment member 4, optimised the unbalance by making it substantially zero regardless of the angle of collet 10.

Preferably according to the invention, each counterweight 8, 8', 9, 9' is substantially H-shaped, the parallel arms of the H being substantially parallel to the local curve of hairspring 3, 5 with which it is associated. As seen in FIGS. 9 to 11, it is noted that these H-shapes add extra local thickness on each hairspring 3, 5, which increases the local stiffness thereof.

Thus, advantageously according to the invention, the stiffness and/or masses added locally by counterweights 8, 8', 9, 9' and attachment member 4 are used to modify the anisochronism slope of balance spring 1.

A simulation of the bottom and slope of the anisochronism curve of balance spring 1 according to the invention has been achieved by varying the length of attachment member 4 or of counterweights 8, 8', 9, 9' along balance spring 1.

| Attachment member 4 [mm] | Counterweight 9, 9' [mm] | Counterweight 8, 8' [mm] | Slope [s/j/100°] | Antinode [$s \cdot j^{-1}$] |
|---|---|---|---|---|
| 0.22 | 0.1 | 0.1 | −8.54 | 0.26 |
| 0.1 | 0.1 | 0.1 | −7.51 | 0.35 |
| 0.22 | 0.04 | 0.22 | −12.97 | 1.14 |
| 0.22 | 0.22 | 0.04 | −7.88 | 0.54 |
| 0.22 | 0.44 | 0.22 | −5.49 | 0.22 |
| 0.22 | 0.33 | 0.22 | −5.05 | 0.29 |
| 0.22 | 0.33 | 0.25 | −4.3 | 0.49 |

The length represents the length of the portion of balance spring 1 which is made rigid by attachment member 4 or counterweight 8, 8', 9, 9'. For the simulation, a balance inertia of 2.5 $mg \cdot cm^2$ and a silicon balance spring having a section of 0.033 mm×0.1 mm and a length L of 45 mm were chosen.

It is seen that when the length of attachment member 4 is decreased, the anisochronism slope tends to be straightened, while the antinode advantageously remains less than 0.4 $s \cdot j^{-1}$. Moreover, when the length of counterweights 9, 9' is reduced, the anisochronism slopes tend to be straightened while the antinode advantageously remains less than 0.3 $s \cdot j^{-1}$. Finally, when the length of counterweights 8, 8' is increased, the anisochronism slope tends to be straightened, while the antinode advantageously remains less than 0.5 $s \cdot j^{-1}$.

Of course, the mass of attachment member 4 and thus of counterweight 8, 8', 9, 9' can also be modified to adapt the anisochronism slope.

| Attachment member 4 [mm] | Counter-weight 9, 9' [mm] | Counter-weight 8, 8' [mm] | Attachment member 4 [$mm^3$] | Slope [s/j/100°] | Antinode [s/j] |
|---|---|---|---|---|---|
| 0.22 | 0.1 | 0.1 | 0.016 | −8.54 | 0.26 |
| 0.22 | 0.1 | 0.1 | 0.008 | −5.58 | 0.56 |
| 0.22 | 0.1 | 0.1 | 0.002 | −4.58 | 0.53 |

It is seen that when the mass of attachment member 4 is reduced, the anisochronism slope tends to be straightened whereas the antinode remains advantageously less than 0.6 $s \cdot j^{-1}$. Consequently, advantageously according to the invention, the anisochronism slope of balance spring 1 can be personalised to compensate for the slope given by the delay of the escapement.

Of course, this invention is not limited to the illustrated example but is capable of various variants and alterations that will appear to those skilled in the art. In particular, other defining criteria can be provided, such as, for example, a limit of the ratio between the internal radius and external radius so that the ends of the hairsprings are not too close to the point of origin where the balance axis has to be located.

Further, advantageously according to the invention, the inner coil 7 of the second hairspring 5 preferably includes a shifting device 13 arranged to be attached to a balance spring stud (not shown) in the plane of second hairspring 5. Shifting device 13 is useful in particular for preventing any particular shape of balance spring 1 making it impossible to assemble due to the proximity of the free end 7 thereof to the balance axis.

As seen in FIGS. 9 to 11, shifting device 13 includes a piece 14 extending from inner coil 7 of second hairspring 5. Preferably, piece 14 is more rigid than the second hairspring 5 to avoid providing any elastic torque to the sprung balance resonator. The piece 14 is preferably made more rigid by greater thickness, such as for example a thickness that is at least three times greater than that of said second hairspring 5, i.e. the width of the strip thereof. It is therefore clear that the shape of piece 14 is partly adapted according to the curvature of the coils of second hairspring 5 so that there is no contact.

Moreover, according to a particular alternative, piece 14 is preferably integral with the second hairspring 5 and, preferably, the height of said second hairspring is substantially equal to that of piece 14, i.e. said piece is contained within the same plane.

The extension piece 14 is further preferably connected to the inner coil 7 of second hairspring 5 via a substantially U-shaped bend 15 in order to further limit the supply of any elastic torque. It is clear that extension piece 14 and bend 15 potentially bring the fixed point formed by the balance spring stud (not shown) closer to end 7 of balance spring 1.

Moreover, piece 14 includes a recess 16, which may be a blind or through recess, of substantially asymmetrical section for cooperating with the balance spring stud (not shown). Finally, as seen in FIGS. 9 to 11, piece 14 may be partially pierced with holes 19 to reduce the mass thereof, and thereby reduce the negative effect of the weight thereof during the assembly of balance spring 1.

Likewise, the inner coil 6 of the first hairspring 3 includes a device 17 for enlarging collet 10 in the plane of the first hairspring 3. Enlargement device 17 is particularly useful for preventing particular shapes of balance spring 1 from making it impossible to assemble due to the proximity of the free end 6 thereof to the balance axis. It is therefore clear that without enlarging device 17, collet 10 would necessarily have a smaller diameter because of the proximity to inner coil 6.

Preferably, enlarging device 17 has a flange 18 extending inner coil 6 of first hairspring 3, flange 18 being more rigid than first hairspring 3 to avoid providing any elastic torque. Moreover, flange 18 is preferably made more rigid by a greater thickness relative to the thickness of hairspring 3, i.e. the width of the blade thereof.

Further, according to a particular alternative, it is preferable for flange 18 to be substantially U-shaped. Finally, flange 18 is preferably integral with first hairspring 3.

Consequently, advantageously according to the invention, it is possible to manufacture a balance spring respecting predetermined conditions so as to reduce the displacement of the centre of mass of the balance spring in contraction and expansion. This small or slight displacement advantageously reduces the antinode of the anisochronism curves to a value substantially equal to or less than $0.5\ s \cdot j^{-1}$. Moreover, advantageously according to the invention, the anisochronism slope of the balance spring may be personalised in order to compensate for the slope given by the delay of the escapement.

Finally, the configuration of FIGS. 9 to 11 defines a very robust axis of symmetry A which minimises the chronometric defects induced by interference in the orthogonal direction to axis A. It is therefore clear that it is possible to maximise manufacturing precision in the attachment member—counterweight direction, i.e. axis A, which is the only critical direction instead of the usual two directions.

Of course, this invention is not limited to the illustrated example but is capable of various variants and alterations that will appear to those skilled in the art. In particular, counterweights 8, 8', 9, 9' can have different shapes/geometry without departing from the scope of the invention. It is also possible to increase the number thereof and/or distribute them differently, i.e. in particular counterweights 8, 8', 9, 9' are not necessarily symmetrical along line A like the curves.

Thus, by way of example, it is perfectly possible to envisage adding two additional counterweights for each hairspring 3, 5, i.e. to have four counterweights, so as to distribute them at substantially 90° relative to each other.

Moreover, when the balance spring is made of silicon, it may be at least partially coated in silicon dioxide in order to make it less sensitive to temperature variations and mechanical shocks. It is thus clear that the variation in section of counterweights 8, 8', 9, 9' also modifies the local thermal compensation of the balance spring.

Finally, it is also possible to envisage compensating for the unbalance induced by the flange 18 by adding an additional counterweight on the opposite side of collet 10.

What is claimed is:

1. A balance spring comprising:

a first hairspring, a curve of which extends in a first plane and an inner coil of which includes a collet, a second hairspring, a curve of which extends in a second plane parallel to the first plane, and an attachment member securing an outer coil of the first hairspring to one end of the second hairspring so as to form a dual balance spring in series, wherein the curve of the first hairspring and the curve of the second hairspring each have a continuously variable pitch and are symmetrical relative to a straight line parallel to the first and second planes and pass through a median plane of projection of the attachment member and each curve being such that the following relation is zero:

$$\vec{P}^{(n)} = \frac{n+1}{L^{n+1}} \int_0^L ds \cdot s^n \cdot \vec{x}(s)$$

where:

$\vec{P}^{(n)}$ is a moment of the balance spring of order n, n being an integer greater than or equal to zero;

L is a length of the balance spring;

$s^n$ represents a curvilinear abscissa along the balance spring to a power of n;

$\vec{x}(s)$ is a parameterization of the balance spring by the curvilinear abscissa thereof;

so as to reduce displacements of a centre of mass thereof during contraction and expansion, and each hairspring further includes at least two counterweights so as to compensate for an unbalance formed by a mass of the attachment member and personalize an anisochronism slope of the balance spring.

2. The balance spring according to claim 1, wherein said at least two counterweights are symmetrical along said same straight line as the curves.

3. The balance spring according to claim 1, wherein two counterweights are located beside the attachment member and two other counterweights are located on a side opposite the attachment member so as to minimize the unbalance.

4. The balance spring according to claim 1, wherein each counterweight is substantially H-shaped, parallel arms of the H being substantially parallel to a local curvature of the hairspring with which said counterweight is associated.

5. The balance spring according to claim 1, wherein at least one of stiffness and mass locally added by said counterweights and said attachment member are used to modify the anisochronism slope of the balance spring.

6. The balance spring according to claim 1, wherein main faces of the attachment member are substantially parallel to said line of symmetry.

7. The balance spring according to claim 1, wherein an inner coil of the second hairspring includes a shifting device arranged to be attached to a balance spring stud in the plane of the second hairspring.

8. The balance spring according to claim 7, wherein the shifting device comprises a piece extending from the inner coil of the second hairspring, said piece being more rigid than said second hairspring to avoid providing elastic torque.

9. The balance spring according to claim 8, wherein the extension piece is connected to the inner coil via a substantially U-shaped bend.

10. The balance spring according to claim 8, wherein the extension piece is integral with the second hairspring.

11. The balance spring according to claim 8, wherein the extension piece is made more rigid by a thickness that is at least three times greater than that of said second hairspring.

12. The balance spring according to claim 8, wherein the piece may be pierced to reduce a mass thereof.

13. The balance spring according to claim 1, wherein the inner coil of the first hairspring includes a device to enlarge the collet in the plane of the first hairspring.

14. The balance spring according to claim 13, wherein the enlarging device includes a flange extending the inner coil of the first hairspring, said flange being more rigid than said first hairspring to avoid providing any elastic torque.

15. The balance spring according to claim 14, wherein the flange is substantially U-shaped.

16. The balance spring according to claim 14, wherein the flange is integral with the first hairspring.

17. The balance spring according to claim 1, wherein the balance spring is formed from silicon.

18. The balance spring according to claim 17, wherein the balance spring includes at least one part coated with silicon dioxide so as to limit a sensitivity thereof to temperature variations and mechanical shocks.

19. A resonator for a timepiece including a balance wherein the balance cooperates with a balance spring according to claim 1.

* * * * *